US006266829B1

(12) United States Patent
Schmidt

(10) Patent No.: US 6,266,829 B1
(45) Date of Patent: Jul. 31, 2001

(54) COMBINATION BEVERAGE CONTAINER AND SPITTOON

(76) Inventor: David Schmidt, 308 St. Theodore, Flint Hill, MO (US) 63385

( * ) Notice: Subject to any disclaimer, the term of this patent is extended or adjusted under 35 U.S.C. 154(b) by 0 days.

(21) Appl. No.: 09/420,371

(22) Filed: Oct. 18, 1999

(51) Int. Cl.[7] ..... A61J 19/00
(52) U.S. Cl. ..... 4/258
(58) Field of Search ..... 4/258, 283, 284, 4/285

(56) References Cited

U.S. PATENT DOCUMENTS 3,798,682 * 3/1974 Harreld ..... 4/258 X
5,325,546 * 7/1994 Setliff ..... 4/258 X

* cited by examiner

*Primary Examiner*—Charles E. Phillips
(74) *Attorney, Agent, or Firm*—Henry W. Cummings

(57) ABSTRACT

A combination beverage container and spittoon includes a bottom portion including outer wall and a first inner wall defining a spittoon space. A beverage container portion is located radially inwardly from the spittoon space having a top portion having tab means for opening the beverage container portion. During installation, the beverage container top portion includes an outer wall which engages an inner wall of a top member with connecting means. The top member also has an outwardly extending extension hollow extension containing a top opening to receive spit, and a bottom opening which after installation aligns with and is in fluid communication with the spittoon space. Circumferentially spaced from the extension, the beverage container portion includes a lip depression to facilitate drinking from the beverage container. An optional space may be provided between the spittoon space and the beverage container for insulating the beverage. At the top an opening may be provided through which insulating material may be introduced into the insulating chamber. An optional compartment may also be provided in the assembly for housing a chewing substance such as tobacco. This compartment is preferably provided at the bottom of the container Means for quickly removing the beverage container portion from the spittoon, for replacing the beverage and for cleaing are provided. An advertisement may be conveniently placed on the outer wall.

13 Claims, 3 Drawing Sheets

COMBINATION BEVERAGE CONTAINER AND SPITTOON

I FIELD OF THE INVENTION

This invention relates to a combination beverage container and spittoon.

II BACKGROUND OF THE INVENTION

U.S. Pat. Nos. 1,518,302; 1,647,427; 4,162,547; 4,768,238; and 4,858,250 disclose various multi-wall portable spittoons.

U.S. Pat. Nos. 3,292,828; 3,301,459; 3,938,695; 4,085,861; 4,331,255; and 4,537,326 disclose are examples of various beverage containers which the user may drink from after the container is opened.

U.S. Pat. No. 3,154,418 discloses a stirring implement containing a portion designated as an advertising trade name.

These references are hereby incorporated into the present application by this reference, and copies may be found in the application file.

III SUMMARY OF THE INVENTION

A. Objects

One object of the invention is to provide a hand held combination beverage container and spittoon.

Another object is to provide a separate chamber to receive the expectorant in the container.

Another object is to provide an easily operable lock so that the assembly may be easily disassembled for cleaning.

Other objects will be apparent from the following Summary, Description, Drawings and claims.

B. Summary

In accordance with the present invention to a combination beverage container and spittoon includes a bottom portion including outer wall and a first inner wall defining a spittoon space. A beverage container portion is located radially inwardly from the spittoon space having a top portion having tab means for opening the beverage container portion. The beverage container top portion includes an outer wall which engages an inner wall of a top member with connecting means. The top member also has an outwardly extending extension hollow extension containing a top opening to receive spit, and a bottom opening which after installation, aligns with and is in fluid communication with the spittoon space. Circumferentially spaced from the extension, the beverage container portion includes a lip depression to facilitate drinking from the beverage container. An optional space may be provided between the spittoon space and the beverage container for insulating the beverage. At the top an opening may be provided through which insulating material may be introduced into the insulating chamber. An optional compartment may also be provided in the assembly for housing a chewing substance such as tobacco. This compartment is preferably provided at the bottom of the container, outboard of the bottom portion of the spittoon space. Means for quickly removing the beverage container portion from the spittoon, for replcaing the beverage, and for cleaing are provided. An advertisement may be conveniently placed on the outer wall.

IV THE DRAWINGS

V DESCRIPTION OF PREFERRED EMBODIMENTS

Figure 1:
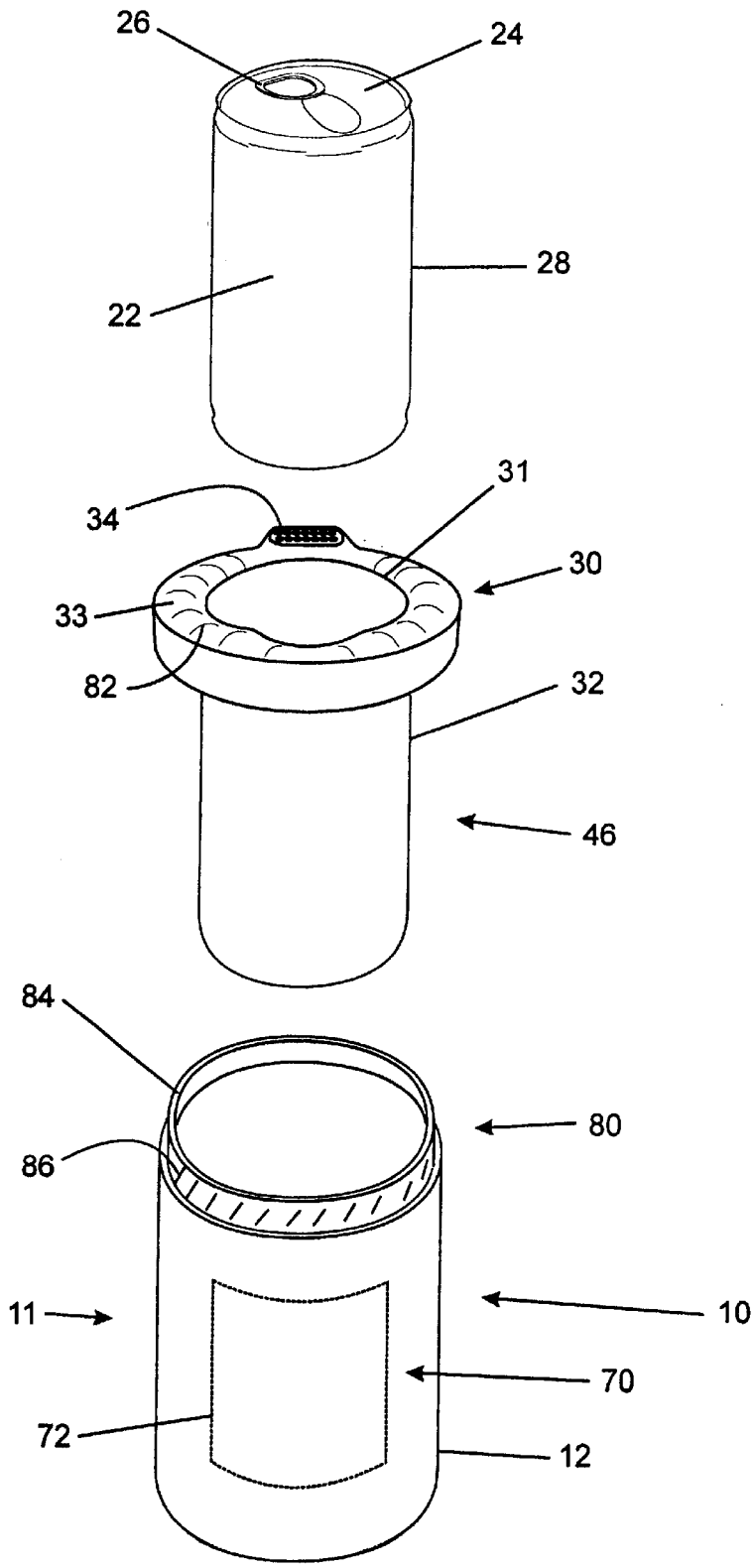
FIG. 1 is an exploded view showing the assembly combination beverage container and spittoon.
Figure 2:
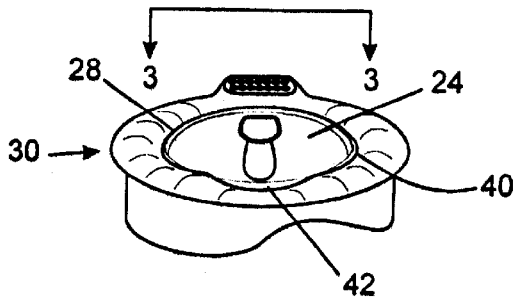
FIG. 2 is a perspective view of the upper portion of the combination beverage container and spittoon.
Figure 3:
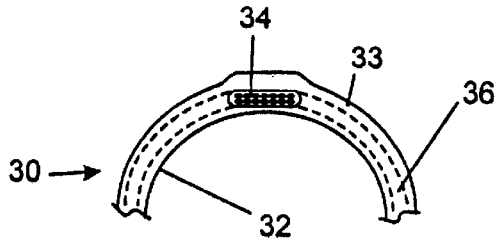
FIG. 3 is a plan view of a portion of the combination beverage container and spittoon looking in the direction of the arrows along the line 3—3 in FIG. 1.
Figure 4:
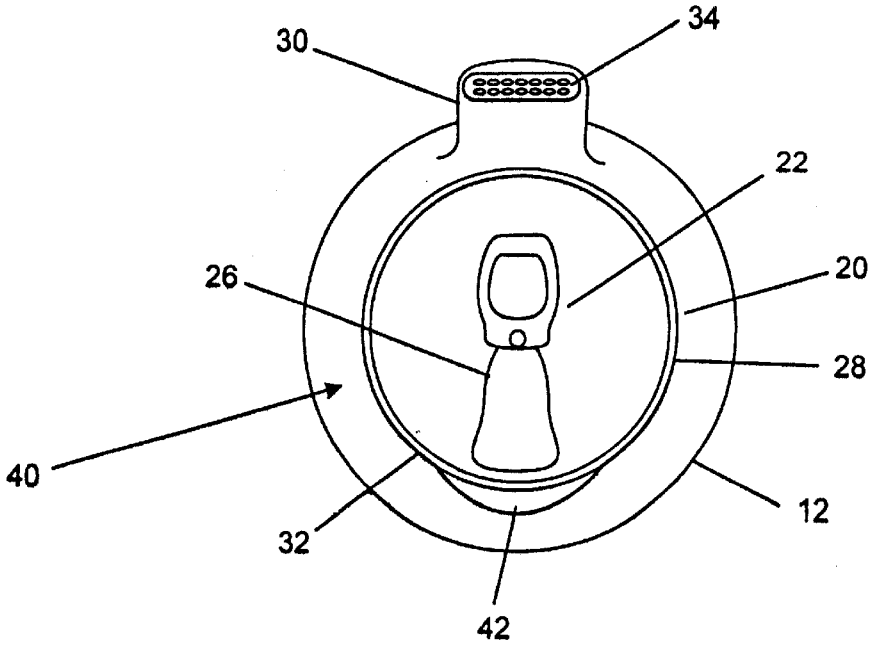
FIG. 4 is a plan view of the combination beverage container and spittoon.
Figure 5:
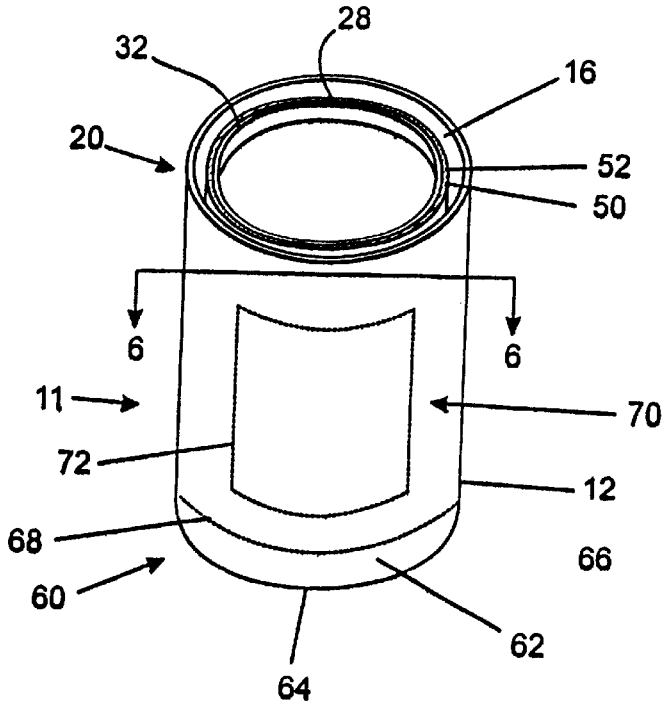
FIG. 5 is a perspective view of the lower portion of the combination beverage container and spittoon.
Figure 6:
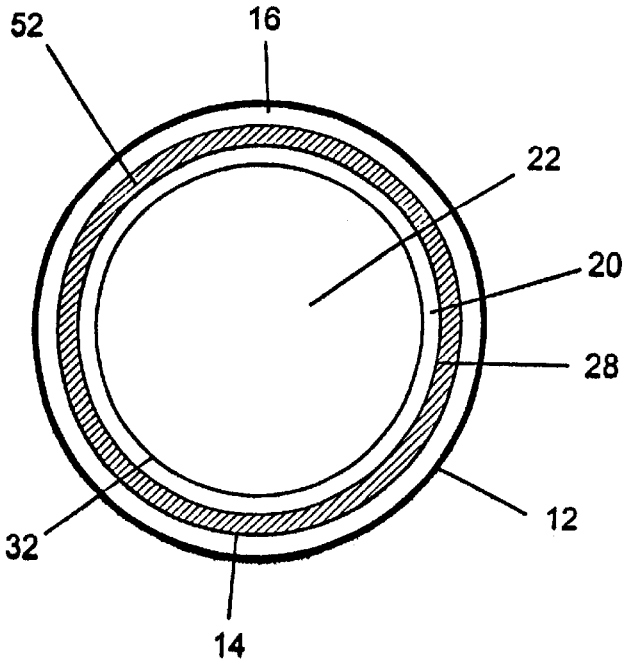
FIG. 6 is a sectional view of the lower portion of the combination beverage container and spittoon looking in the direction of the arrows along the line 6—6 in FIG. 5.

In accordance with the present invention a combination beverage container and spittoon 10 made of plastic includes a lower portion 11 including outer wall 12 and a first inner wall 14 defining a spittoon space 16.

A beverage container portion 20 is located radially inwardly from the spittoon space having a beverage container 22 disposed therein, the container being provided, with a top portion 24 having tab means 26 for opening the beverage container portion.

The beverage container portion 20 includes an outer wall 28 which engages a depending inner wall 32 of a top member 30 with connecting means 31, such as an interference fit during installation.

Top member 30 also has an (outwardly extending extension hollow extension 33) containing a top opening 34 to receive spit, and a bottom opening 36 which, after assembly with bottom portion 11, aligns with and is in fluid communication with the spittoon space 14.

Circumferentially spaced from the extension 33, the top portion 30 extends to a beverage drink portion 40 which includes a lip depression 42 to facilitate drinking from the beverage container.

An optional compartment 60 may also be provided in the assembly for housing a chewing substance such as tobacco. This compartment is preferably provided at the bottom of the container, with a wall 64 defining a chamber 62 outboard of the bottom portion of the spittoon space. Tobacco may be obtained from optional chamber 62 including wall 64, a hinge 66 and a latch 68 of conventional construction.

An advertisement 70 may be conveniently placed on the outer wall as indicated at 72.

Means 80 for quickly assembling the top portion with the bottom portion to locate the beverage container, for replacing the beverage container, and for cleaning are provided including projections 82 located on extension wall portion 33 which engage slots 86 located in ring 84, extending from bottom outer wall 12. Rotation in one direction causes engagement. Rotation in the opposite direction causes quick disengagement for beverage replacement and/or cleaning.

In operation, a beverage container 22 is inserted within top member 30, with beverage top wall portion 28 engaging top wall member 32 with connecting means such as an interference fit to form an integral assembly 46.

Then, assembly 46 is placed within lower portion 11 bottom opening 36 aligning with and becoming in fluid communication with the spittoon space 14.

Then connection means 80 for removably connecting the top portion 46 with the bottom portion 11 is activated by rotation wherein projections 82 located on top wall portion 33 engage slots 86 located in ring 84, upon rotation in a first direction.

The beverage may be drunk with the user opening tab 26 and drinking through lip depression 42. Spit entering opening 34 flows through hollow extension 33 through bottom opening 36 into spittoon space 16.

Tobacco may be obtained from optional chamber 60 by disengaging latch 68 and pivoting wall 64, about hinge 66 to remove tobacco.

When the beverage container is empty, to replace the container, rotation in the opposite direction causes quick disengagement for beverage replacement and cleaning of spittoon space 16 and top portion chamber 33.

What is claimed is:

1. A combination beverage container and spittoon comprising: a bottom portion including an outer wall and a first inner wall defining a spittoon space;

a beverage container portion located radially inwardly from the spittoon space;

a top member including an inner wall adapted to engage an outer wall of a beverage container with connecting means;

said top portion having an outwardly extending hollow extension containing a top opening to receive spit, and a bottom opening which, after assembly, is in fluid communication with said spittoon space; and means for quickly removing said bottom portion from said top portion for replacing the beverage container and cleaning.

2. A combination beverage container and spittoon according to claim 1 wherein circumferentially spaced from said extension, said beverage container portion includes a lip having a depression to facilitate drinking from the beverage container.

3. A combination beverage container and spittoon according to claim 2 wherein the means for quickly removing the beverage container portion from the spittoon for replacing the beverage and cleaning comprise slots in said top member and projections in said bottom portion.

4. A combination beverage container and spittoon according to claim 1 wherein the means for quickly removing the beverage container portion from the spittoon for replacing the beverage and cleaning comprise slots in said top member and projections in said bottom portion.

5. A combination beverage container and spittoon according to claim 1 wherein a chewing substance compartment is provided in the assembly for housing a chewing substance.

6. A combination beverage container and spittoon according to claim 5 wherein said chewing substance compartment is provided at the bottom of the container, outboard of the bottom portion of the spittoon space.

7. A combination beverage container and spittoon according to claim 6 wherein the means for quickly removing the beverage container portion from the spittoon for replacing the beverage and cleaning comprise slots in said top portion and projections in said bottom portion.

8. A combination beverage container and spittoon according to claim 1 wherein an advertisement is placed on said outer wall.

9. A combination beverage container and spittoon comprising: a bottom portion including an outer wall and a first inner wall defining a spittoon space;

a beverage container portion located radially inwardly from the spittoon space;

a top member including an inner wall adapted to engage an outer wall of a beverage container with connecting means;

said top member also having an outwardly extending hollow extension containing a top opening to receive spit, and a bottom opening which, after assembly, is in fluid communication with said spittoon space;

said top portion including a lip having a depression to facilitate drinking from the beverage container; and means for quickly removing said bottom portion from said top portion for replacing the beverage container and for cleaning.

10. A combination beverage container and spittoon according to claim 9 wherein the means for quickly removing the top member from the bottom portion for replacing the beverage and cleaning comprise slots in said top member and projections in said bottom portion.

11. A combination beverage container and spittoon according to claim 9 wherein a chewing substance compartment is provided in the assembly for housing a chewing substance.

12. A combination beverage container and spittoon according to claim 11 wherein said chewing substance compartment is provided at the bottom of the container, outboard of the bottom portion of the spittoon space.

13. A combination beverage container and spittoon according to claim 12 wherein an advertisement is placed on said outer wall.

* * * * *